United States Patent [19]

Schultz

[11] 4,216,558

[45] Aug. 12, 1980

[54] WATER INLET ADAPTER VALVE FOR BOATS

[76] Inventor: Gary W. Schultz, 1132 La Salle Ave., Niagara Falls, N.Y. 14301

[21] Appl. No.: 941,959

[22] Filed: Sep. 13, 1978

[51] Int. Cl.[3] ..... B63B 17/00

[52] U.S. Cl. ..... 9/1.1; 114/197; 141/95; 141/286; 141/392; 285/93

[58] Field of Search ..... 114/197, 198, 270; 141/95, 286, 392; 138/89, 96 T; 285/DIG. 2, 93, 156, 32; 9/1.1, 1.7, 400

[56] References Cited

U.S. PATENT DOCUMENTS

| | | | |
|---|---|---|---|
| 1,115,912 | 11/1914 | Dodson | 285/32 |
| 1,124,575 | 1/1915 | Zimmer | 285/93X |
| 3,874,317 | 4/1975 | Hikita | 114/198 |
| 3,878,807 | 4/1975 | Reskusic | 114/198 |
| 3,893,487 | 7/1975 | Engelking | 138/89 |

*Primary Examiner*—Sherman D. Basinger

[57] ABSTRACT

This adapter consists primarily of a main body with an insert, which connects to the deck fitting of a boat, so as to enable a constant flow of water to be supplied, by a garden hose, to the boat's holding tanks, when the boat is at dock-side. The adapter includes a screw cap, so as to enable the tanks to be filled by bucket, or other methods when desired, and it further includes an inspection window, and a strainer.

5 Claims, 1 Drawing Figure

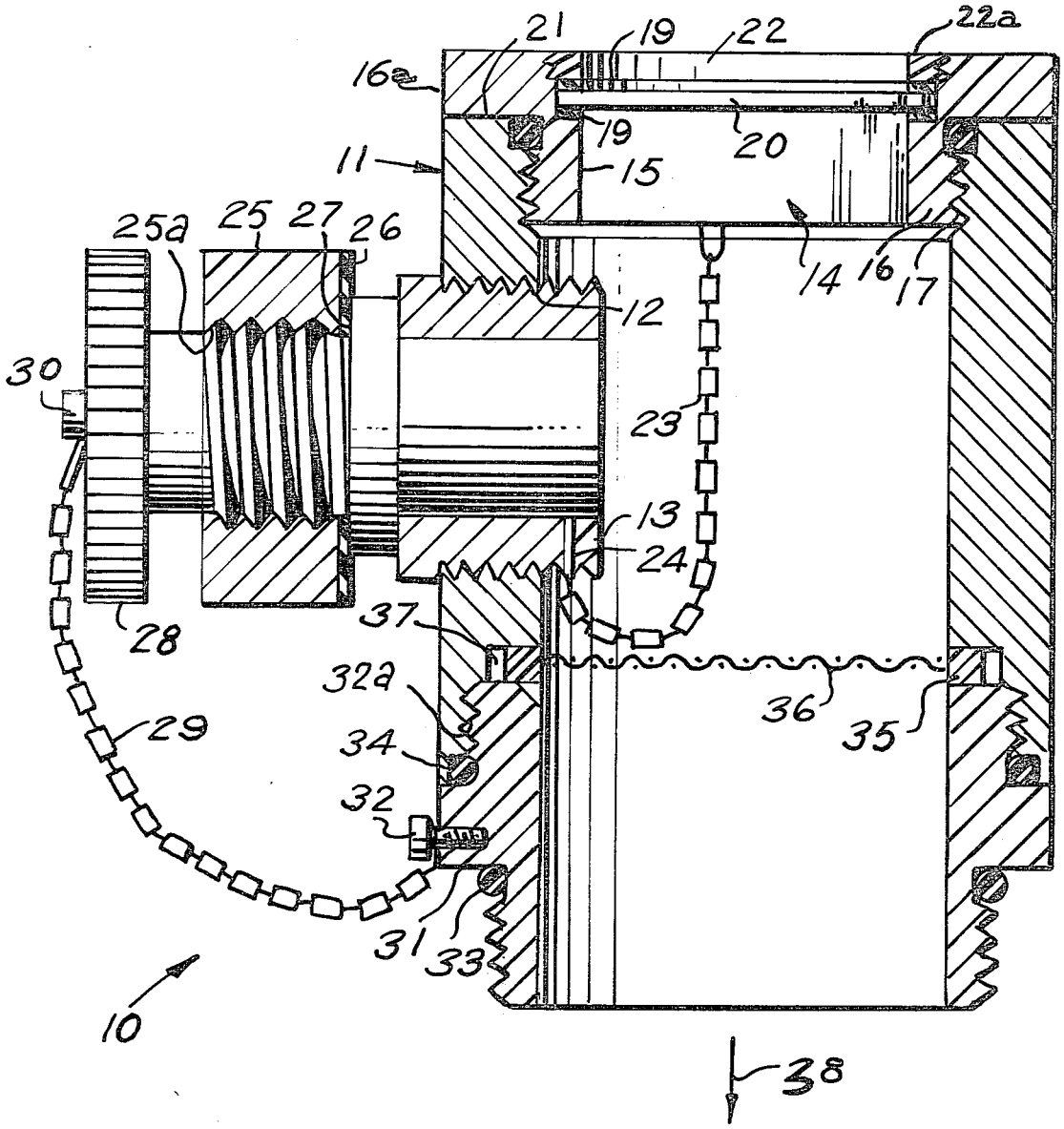
21
19
22
22a
16a
19
20
11
15
25a
25
27
26
14
16
17
12
30
23
13
24
28
37
32a
36
35
29
34
32
31
33
10
38

WATER INLET ADAPTER VALVE FOR BOATS

This invention relates to valves, and more particularly, to a water inlet adapter valve for boats.

It is, therefore, the primary object of this invention to provide a water inlet adapter valve for boats of all types, which will enable the water holding tanks to be filled by a garden hose.

Another object of this invention is to provide a water inlet adapter valve, which will be of such structure, that it will also enable the holding tanks to be filled by bucket, or other methods, when desired.

Another object of this invention is to provide a water inlet adapter, which will have a hose connector fitting for a garden hose, and the fitting will have a removable plug, that is retained against misplacement, by a chain.

A further object of this invention is to provide a water inlet adapter for boats, which will include a removable inspection glass for observing the water flowing into the holding tanks, and a strainer will be removably secured within the adapter valve, for retaining any foreign particles that may be present in the water.

Other objects of the invention are to provide a water inlet adapter for boats, which will be simple in design, inexpensive to manufacture, easy to install, and efficient in operation.

These, and other objects, will become readily evident, upon a study of this specification and the accompanying drawing in which the drawing is the sole view of the invention, and is shown in elevation and partly in section.

According to this invention, a water inlet adapter valve 10 is shown to include a hollow cylindrical valve body 11, having a threaded side opening 12, in which is threaded a fitting 13 for a purpose which will hereinafter be described.

An inspection glass 14, of cylindrical and flanged configuration, is removably received within opening 15 of externally threaded cap 16, and sleeve **16*a* is threaded into opening 17, at the upper end of valve body 11, for visual inspection of the water flow. An "O" ring provides sealing between sleeve 16*a* and the valve body 11, in the well known manner, and a pair of gaskets 19 abut with the flange 20 of glass 14. The opposite sides of gaskets 19 abut, one with the top 21 of valve body 11, and the other with a face 22 of an externally threaded ring 22*a*, which is threaded into the upper end of cap 16. The cap 16 is removed only when it is desired to fill the boat's holding tanks with water by bucket, or other methods. A chain, of suitable material, is fixedly secured, at one end, to the bottom of inspection glass 14, and the opposite end is fixedly secured to pin 24, secured in fitting 13, so as to retain fitting glass 14, to fitting 13, which will prevent loss, or misplacement thereof. An internally threaded hose connector 25 abuts with a gasket 26 on shoulder 27 of fitting 13, and a removable hose plug 28 is threaded into opening 25*a***, when a garden hose is not attached thereto.

A chain 29 of suitable material, is secured to hose plug 28, at one end, by a screw fastener 30, and is secured, at its' opposite end, to an insert sleeve 31 of valve body 11, by a screw fastener 32, the chain being used to retain the hose plug 28 against loss or misplacement. An "O" ring 33, on insert sleeve 31, provides sealing when sleeve 31 is connected to the deck fitting of the water holding tanks. An "O" ring 34, between sleeve 31 and valve body 11, provides sealing between body 11 and sleeve 31, in a well known manner.

A ring 35, having a screen 36 fixedly secured therein, is secured in the recessed opening 37 of valve body 11, by the upper end of sleeve 31.

When the boat is dock-side, the hose plug 28 is removed, and a garden hose is secured in its' place. When the water is turned on, it will flow in the direction as indicated by the arrow 38.

While various changes may be made in the detail construction it shall be understood, that such changes will be within the spirit and scope of the present invention, as is defined by the appended claims.

What I now claim is:

1. A water inlet adapter valve body for boats comprising:

a hollow cylindrical valve body having two ends;

a cap threadedly secured in one end of said hollow cylindrical valve body, said cap having an inspection glass fixed therein;

an insert sleeve threadedly secured to the other end of said hollow cylindrical valve body, said insert sleeve being adapted to secure said hollow cylindrical valve body to a boat;

a fitting threaded in a side of said hollow cylindrical valve body, said fitting adapted to connect a hose to said hollow cylindrical valve body;

a plug for closing said fitting; and a screen secured between an end of said insert sleeve and an internal shoulder of said hollow cylindrical valve body.

2. A water inlet adapter valve as set forth in claim 1 wherein a chain is secured to said insert sleeve and to said plug so as to retain the plug against loss.

3. A water inlet adapter valve as set forth in claim 1 wherein a second chain is secured to said inspection glass and to said fitting so as to prevent loss of said inspection glass.

4. A water inlet adapter valve as set forth in claim 1 wherein said inspection glass is held within said cap by a ring threaded into one end of said cap and a gasket on each side of said inspection glass.

5. A water inlet adapter valve as set forth in claim 1 wherein an O ring is located between a portion of said cap and a portion of said hollow cylindrical valve body, and a second O ring is located between a portion of said insert sleeve and a portion of said hollow cylindrical valve body.

* * * * *